United States Patent [19]

Kuwahara

[11] Patent Number: 4,498,041

[45] Date of Patent: Feb. 5, 1985

[54] CONSTANT CURRENT SOURCE CIRCUIT

[75] Inventor: Hisao Kuwahara, Kamakura, Japan

[73] Assignee: Tokyo Shibaura Denki Kabushiki Kaisha, Kanagawa, Japan

[21] Appl. No.: 528,591

[22] Filed: Sep. 1, 1983

[30] Foreign Application Priority Data

Sep. 1, 1982 [JP] Japan ..... 57-151917

[51] Int. Cl.[3] ..... G05F 3/20

[52] U.S. Cl. ..... 323/316; 307/297; 330/288

[58] Field of Search ..... 323/312, 315, 316, 317, 323/299; 307/296 R, 297; 330/288, 297

[56] References Cited

U.S. PATENT DOCUMENTS

| | | | |
|---|---|---|---|
| 3,922,596 | 11/1975 | Cave et al. | 323/316 |
| 4,055,774 | 10/1977 | Ahmed | 323/316 X |
| 4,297,646 | 10/1981 | Locascio et al. | 323/316 X |
| 4,308,496 | 12/1981 | Nagano | 323/315 |
| 4,361,797 | 11/1982 | Kojima et al. | 323/316 |

OTHER PUBLICATIONS

Hart et al., "The Design of Constant Current Sources," Electronic Engineering 85–88, vol. 49, No. 593, (Jun. 1977).

Gray, P. R., and Meyer, R. G., *Analysis and Design of Analog Integrated Circuits*, 364–365, (1977).

*Primary Examiner*—Peter S. Wong

*Attorney, Agent, or Firm*—Finnegan, Henderson, Farabow, Garrett & Dunner

[57] ABSTRACT

A circuit producing a relatively stable constant current during power source voltage fluctuations and driven by a relatively low DC power source voltage, which is includes a power source voltage supply terminal to which is supplied a DC power source voltage, a reference potential terminal, and a current source. A first transistor is connected at its collector to the power source voltage supply terminal via the current source and at its emitter to the reference potential terminal. A current mirror circuit is also used, and a second transistor is connected at its collector to the base of the first transistor via the current mirror circuit and at its emitter to the reference potential terminal. The base of the second transistor is connected to the collector of the first transistor. A third transistor is connected between the power source voltage supply terminal and the reference potential terminal via output terminals to which a load means is connected. The base of the third transistor is connected for being driven by a current proportional to a current of the second transistor.

6 Claims, 7 Drawing Figures

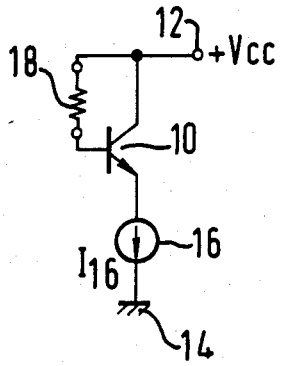
FIG. 1.
PRIOR ART
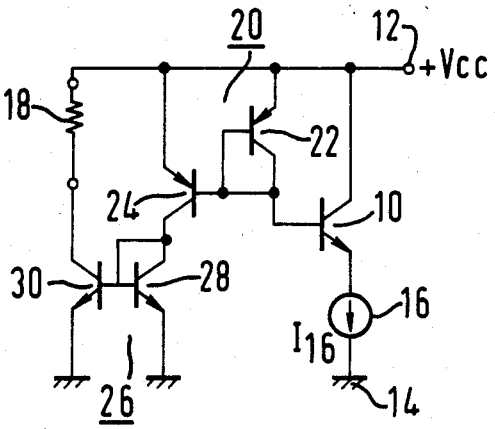
FIG. 2.
PRIOR ART
FIG. 3.
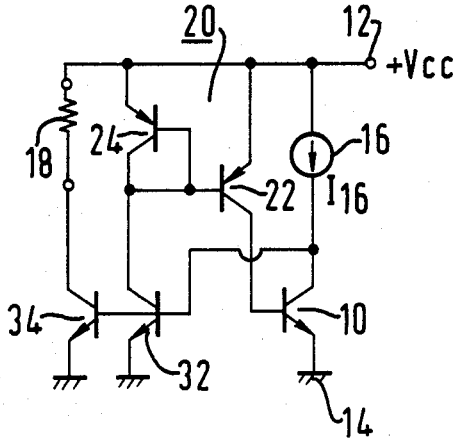
FIG. 4.
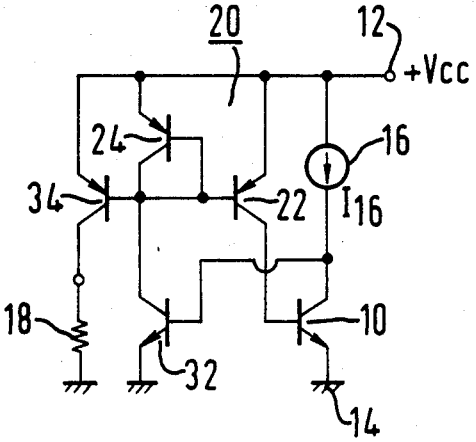

CONSTANT CURRENT SOURCE CIRCUIT

BACKGROUND OF THE INVENTION

1. Field of the Invention

This invention relates to a constant current source circuit, and more particularly, to a semiconductor current source circuit having constant current characteristics whose current level is substantially unaffected by a change in the source voltage which biases the circuit.

2. Description of the Prior Art

Constant current source circuits are often used in integrated circuit (IC) design, and many forms of these circuits have been developed. A requirement for constant current sources is that the operating current does not change when a variation in the power source voltage occurs. Constant current source circuits are also ideally required to operate at a low power supply voltage with low power consumption.

In practice, certain of the constant current source circuits used in integrated circuits have low power consumption but fail to achieve good constant current characteristics. Alternatively, other constant current source circuits are able to maintain a constant current level but are found to be less efficient insofar as power consumption is concerned.

Two types of conventional constant current source circuits are shown in FIGS. 1 and 2 and are more fully discussed below in the section entitled "Description of the Preferred Embodiments".

SUMMARY OF THE INVENTION

The subject invention relates to a novel constant current source circuit for producing an operating current which remains substantially stable in the presence of fluctuations in power source voltage, yet which is able to operate at a relatively low power supply voltage with low power consumption.

These and other objects are achieved in the constant current source circuit of the invention which includes a power source voltage supply terminal which is designed to receive a DC power source voltage; a reference potential terminal; a current source; a first transistor connected at its collector to said power source voltage supply terminal via said current source and at its emitter to said reference potential terminal; a current mirror circuit; a second transistor connected at its collector to the base of said first transistor via said current mirror circuit and at its emitter to said reference potential terminal, the base of said second transistor being connected to the collector of said first transistor, to effect a closed feedback loop through said second transistor, said mirror circuit and said first transistor for maintaining a constant current to the load; and a third transistor connected between said power source voltage supply terminal and said reference potential terminal via output terminals to which the load is designed to be connected, the base of said third transistor being connected to be driven by a current proportional to a current of said second transistor.

Accordingly, an object of the present invention is to provide a constant current source circuit which produces a stable current substantially unchanged by variations in its power source voltage.

Another object of the present invention is to provide a constant current source circuit which is able to operate with a low power supply voltage.

A further object of the present invention is to provide a constant current source circuit which is low in power consumption.

Additional objects, advantages, and features of the present invention will further become apparent to persons skilled in the art from a study of the following description and of the accompanying drawings, in which:

BRIEF DESCRIPTION OF THE DRAWINGS

FIGS. 1 and 2 are circuit diagrams of conventional constant current source circuits relating to the field of the invention.

FIG. 3 is a circuit diagram showing a preferred embodiment of the constant current source circuit of the present invention.

FIGS. 4 to 7 are circuit diagrams of modified embodiments of the embodiment of FIG. 3.

DESCRIPTION OF THE PREFERRED EMBODIMENTS

Figure 5:
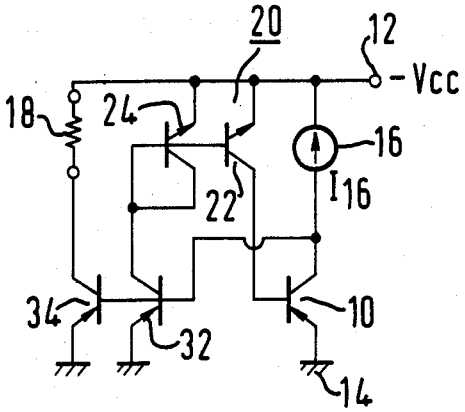

The present invention will now be described in detail with reference to the accompanying drawings, namely, FIGS. 1 to 7. Throughout the drawings like reference numerals and letters are used to designate like or equivalent elements for the sake of simplicity of explanation.

Referring now to FIG. 1, there is shown an example of a constant current source circuit in common use in transistor circuits. As shown, NPN transistor 10 is connected at its collector to power source voltage supply terminal 12 to which is applied the positive power source voltage $V_{cc}$. The emitter of transistor 10 is connected to reference potential terminal 14 via current source 16. The base of transistor 10 is connected via load resistor 18 to its collector and the power source voltage supply terminal 12. If the output current of current source 16 is $I_{16}$, and grounded emitter circuit current amplification factor of transistor 10 is $\beta_1$, the output current $I_{out}$ flowing through load resistor 18 (i.e., base current $i_b$ of transistor 10) is as follows:

$$I_{out} = I_b = \frac{I_{16}}{1 + \beta_1}.$$

and output current $I_{out}$ is thus kept constant.

However, current source 16 and the base-emitter junction of transistor 10 become connected in series between power source terminal 12 and reference potential terminal 14 when load resistor 18 is shunted, and thus a problem arises of a reduction in the utilization factor $\eta V_{cc}$ of power source voltage $V_{cc}$ in respect of load resistor 18. In other words, if the voltage of the base-emitter junction of transistor 10 is $V_{be}$, and the saturation voltage of current source 16 is $V_{16(sat)}$, the above-mentioned utilization factor $\eta V_{cc}$ can be expressed as follows:

$$\eta V_{cc} = \frac{V_{cc} - V_{be} - V_{16(sat)}}{V_{cc}}.$$

If we assume, for example, that $V_{cc}=3$ V, $V_{be}=0.7$ V, and $V_{16(sat)}=0.1$ V:

$$\eta V_{cc} = \frac{3 - 0.7 - 0.1}{3} = \frac{2.2}{3} = 0.73.$$

Thus, only 73% of power source voltage $V_{cc}$ is supplied to load resistor 18.

One means of increasing power source voltage utilization factor $\eta V_{cc}$ that has been devised previously is the constant current source circuit illustrated in FIG. 2. As shown, NPN transistor 10 and constant current source circuit 16 are connected in series between power source voltage supply terminal 12 and reference potential terminal 14 as in FIG. 1. However, the base of transistor 10 is connected to load resistor 18 via a first current mirror circuit 20 consisting of PNP transistors 22, 24, and a second current mirror current 26 consisting of NPN transistors 28, 30. Thus transistor 10 is supplied its base current $I_b$ from load resistor 18 via first and second current mirror circuits 20, 26.

If the saturation voltage between the collector and emitter of transistor 30 is taken as $V_{ce(sat)}$, power source utilization factor $\eta V_{cc}$ can be expressed as follows:

$$\eta V_{cc} = \frac{V_{cc} - V_{ce(sat)}}{V_{cc}}$$

If we assume, for example, that $V_{cc}=3$ V and $V_{ce(sat)}=0.1$ V, then $$V_{cc} = \frac{3 - 0.1}{3} = \frac{2.9}{3} = 0.97;$$

which means that 97% of power source $V_{cc}$ is supplied to load resistor 18, representing an increase in $\eta V_{cc}$ as compared with the constant current source circuit shown in FIG. 1.

However, in the conventional constant current source circuit shown in FIG. 2, current source 16 and the base-emitter junctions of transistors 10, 22 are all connected in series between power source voltage supply terminal 12 and reference potential terminal 14. This being so, the minimum value of power source voltage $V_{cc(min)}$ required to operate the constant current source circuit shown in FIG. 2 is, if the voltage of the base-emitter junction of transistor 22 is taken as $V_{be22}$ and $V_{be10}$ is the voltage of the base-emitter junction of transistor 10 as follows:

$$V_{cc(min)} = V_{16(sat)} + V_{be10} - V_{be22}.$$

If we assume that $V_{16(sat)}=0.1$ V, $V_{be10}=0.7$ V, and $V_{be22}=0.7$ V, we have the following:

$$V_{cc(min)} = 0.1 + 0.7 - (-0.7) = 1.5\ V.$$

Thus, although the power source utilization factor has been increased, another problem has arisen, namely, the minimum operating voltage $V_{cc(min)}$ is high.

Referring now to FIG. 3, there is shown that circuit diagram of a constant current source circuit constructed according to the present invention. In FIG. 3, first NPN transistor 10 has its collector connected to power source voltage supply terminal 12 via current source 16 and its emitter connected to reference potential terminal 14. The base of first NPN transistor 10 is connected to current mirror circuit 20 consisting of PNP transistors 22, 24. First PNP transistor 22 is connected between the base of first NPN transistor 10 and power source voltage supply terminal 12. Second PNP transistor 24, which is connected in a diode configuration, is connected between power source voltage supply terminal 12 and the base of first PNP transistor 22. The collector of second PNP transistor 24 is connected to reference potential terminal 14 via second PNP transistor 32. The base of second PNP transistor 32 is not only connected to the collector of first NPN transistor 10 but also connected to the base of third PNP transistor 34. The collector of third PNP transistor-34 is connected to power source voltage supply circuit 12 via load resistor 18, and its emitter is connected to reference potential terminal 14.

The constant current source circuit illustrated in FIG. 3 forms a closed loop circuit, consisting of the base of transistor 32, the collector of transistor 32 (i.e., the collector of transistor 24), the base of transistor 22, the collector of transistor 22 (i.e., the base of transistor 10), and the collector of transistor 10 (i.e., the base of transistor 32). In operation, when, for example, collector current $I_{c10}$ of transistor 10 increases, negative feedback is effected, with base current $I_{b32}$ of transistor 32, collector current $I_{c32}$ of transistor 32, base current $I_{b22}$ of transistor 22, collector current $I_{c22}$ of transistor 22 (i.e., base current $I_{b10}$ of transistor 10), and collector current $I_{c10}$ of transistor 10 all decreasing. Thus, output current $I_{out}$ flowing through load resistor 18 is kept constant at the desired value, this value being established by current source 16 and transistors 10 to 34.

To find output current $I_{out}$ flowing to load resistor 18, taking the grounded emitter circuit current amplification factors of NPN transistors 10, 32 and 34 all to be equal to $\beta_n$, and the grounded emitter current amplification factors of PNP transistors 22, 24 to be equal to $\beta_p$, and assuming that the characteristics of PNP transistors 22, 24 of current mirror curcuit 20 are exactly matched, and assuming likewise that the characteristics of NPN transistors 32, 34 are exactly matched, we have the following formula:

$$I_{out} = I_{c34} = I_{c32} = \frac{I_{16}}{2/\beta_n + \beta_n/(1 + 2/\beta_p)};$$

where $I_{c34}$, $I_{c32}$ represent the collector of NPN transistors 34, 32, respectively, and $I_{16}$ represent the current of current source 16.

Assuming that $\beta_n >> 2$, $\beta_p >> 2$, then $2/\beta_n \approx 0$, $2/\beta_p \approx 0$, and the load current or output current $I_{out}$ can be expressed, from the formula given above, as follows:

$$I_{out} = \frac{I_{16}}{\beta_n}.$$

Thus, if all current $I_{16}$ of current source 16 can be considered to be the collector current $I_{c10}$ of transistor 10, then it is $B_n$ times the base current $I_{b10}$ of transistor 10 which is the collector current $I_{c22}$ of transistor 22, which latter current equals the collector current $I_{c32}$ of transistor 32 or collector current $I_{c34}$ of transistor 34, i.e., output current $I_{out}$ flowing to load resistor 18.

In the circuit shown in FIG. 3, if the saturation voltage between the collector and emitter of transistor 34 is taken as $V_{ce34(sat)}$, the power source voltage utilization factor $\eta V_{cc}$ can be expressed by the following:

$$\eta V_{cc} = \frac{V_{cc} - V_{ce34(sat)}}{V_{cc}}.$$

If, for example, $V_{cc}=3$ V, and $V_{ce34(sat)}=0.1$ V, then;

$$V_{cc} = \frac{3 - 0.1}{3} = 0.97;$$

which gives a high power source voltage utilization factor $\eta V_{cc}$, with 97% of power source voltage $V_{cc}$ being supplied to load resistor 18.

Further, if the base-emitter junction voltages $V_{be10}$, $V_{be24}$ of transistors 10, 43 are taken as $V_{be10}=V_{be24}$, and collector-emitter saturation voltages $V_{ce22(sat)}$, $V_{ce32(sat)}$ of transistors 22, 32 are taken as $V_{ce22(sat)}=V_{ce32(sat)}$, then the minimum operational value $V_{cc(min)}$ of power source voltage $V_{cc}$ is as follows:

$$V_{cc(min)} = V_{be10} + V_{ce22(sat)}$$
$$= V_{be24} + V_{ce32(sat)}.$$

If, for example, $V_{be10}=V_{be24}=0.7$ V, and $V_{ce22(sat)}=V_{ce32(sat)}=0.1$ V, then:

$$V_{cc(min)}=0.7+0.1=0.8 \text{ V};$$

which is lower than in the conventional constant current source circuit in FIG. 2.

Referring now to FIG. 4, there is shown a partly modified form of the constant current source circuit of FIG. 3. The connection of the base of transistor 22, the base and collector of transistor 24, and the collector of transistor 32, is connected to the base of PNP transistor 34. The emitter of transistor 34 is connected to power source voltage supply terminal 12, and its collector is connected to reference potential terminal 14 via load resistor 18. With this type of configuration, since the collector current $I_{c22}$ of transistor 22 is base current $I_{b10}$ of transistor 10, then, if the characteristics of transistors 22, 34 are exactly matched, collector current $I_{c34}$ of transistor 34, that is to say, output current $I_{out}$, is:

$$I_{out}=I_{c34}=I_{c22}=I_{b10};$$

with output current $I_{out}$ equal to base current $I_{b10}$ of transistor 10. It will be readily understood from the above explanation that the same results as with the circuit of FIG. 3 can be obtained with the configuration shown in FIG. 4.

Figure 6:
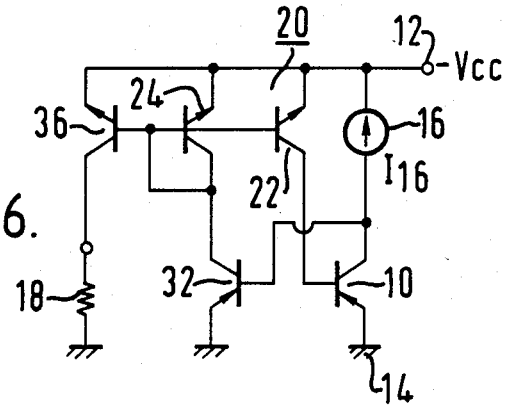

FIGS. 5 and 6 show further modified circuits in which the polarity of each of transistors 10 to 34 in the circuits illustrated in FIGS. 3 and 4 has been inverted. In these two cases, the power source voltage becomes negative, i.e., $-V_{cc}$. With the polarity of current source 16 inverted, circuit operation is similar to that of the circuits of FIGS. 3 and 4, and similar results are obtained.

Figure 7:
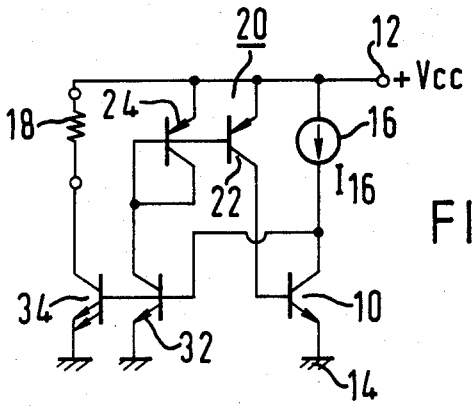

Next, referring to FIG. 7, there is shown an example of still another modified form of the circuit of FIG. 3. The area ratio of the emitters of transistors 32, 34 has been set at 1:N. In this case, output current $I_{out}$ is as follows:

$$I_{out} = N \times I_{b10} = N \times \frac{I_{16}}{\beta_n}$$

In the circuits depicted in FIGS. 3 to 7, by changing the emitter area ratios of any of the transistors except transistor 10, or inserting a resistance in series with any of the emitters, the collector current ratios of any of transistors 22 to 34 can be changed, and made into N-times or 1/N-times the base current of the transistor 10.

The present invention is not restricted to the embodiment described above. It can be embodied in various modified forms, provided there is no departure from the essential substance of the invention as defined in the accompanying claims.

What is claimed is:

1. A constant current source circuit for providing a current to a load comprising:

a power source voltage supply terminal which is designed to receive a DC power source voltage;

a reference potential terminal;

a current source;

a first transistor connected at its collector to said power source voltage supply terminal via said current source and at its emitter to said reference potential terminal;

a current mirror circuit;

a second transistor connected at its collector to the base of said first transistor via said current mirror circuit and at its emitter to said reference potential terminal, the base of said second transistor being connected to the collector of said first transistor, to effect a closed feedback loop through said second transistor, said mirror circuit and said first transistor for maintaining a constant current to the load; and a third transistor connected between said power source voltage supply terminal and said reference potential terminal via output terminals to which the load is designed to be connected, the base of said third transistor being connected to be driven by a current proportional to a current of said second transistor.

2. A constant current source circuit according to claim 1, wherein said second and third transistors are of the same polarity, and the base of said third transistor is connected to the base of said second transistor.

3. A constant current source circuit according to claim 1, wherein said second and third transistors are of opposite polarity, and the base of said third transistor is connected to the collector of said second transistor.

4. A constant current source circuit according to claim 1, wherein said third transistor has a greater base-emitter junction area than said second transistor.

5. A constant current source circuit according to claim 2, wherein said third transistor has a greater base-emitter junction area than said second transistor.

6. A constant current source circuit according to claim 3, wherein said third transistor has a greater base-emitter junction area than said second transistor.

* * * * *